United States Patent [19]

Kimsey, Jr.

[11] Patent Number: 4,949,401

[45] Date of Patent: Aug. 21, 1990

[54] COLLAPSIBLE MULTICOMPARTMENTED PACK FOR THE BACK OF A GARMENT

[76] Inventor: Cheston B. Kimsey, Jr., P.O. Box 197, Clarkesville, Ga. 30523

[21] Appl. No.: 367,621

[22] Filed: Jun. 19, 1989

[51] Int. Cl.[5] ..... A41D 1/02; A41D 1/04

[52] U.S. Cl. ..... 2/102; 2/86; 2/94; 2/108; 190/1; 190/103; 190/107; 224/153; 383/4; 383/37; 383/38

[58] Field of Search ..... 2/69, 85, 86, 89, 93, 2/94, 102, 108; 224/153, 209; 190/1, 15 R, 22, 103, 104, 107, 111, 112, 125; 383/4, 37, 38

[56] References Cited

U.S. PATENT DOCUMENTS

| | | | |
|---|---|---|---|
| 850,312 | 4/1907 | Norwood | 2/94 |
| 1,137,047 | 4/1915 | Bushwick | 190/103 |
| 1,666,878 | 4/1928 | Johnson | 190/111 |
| 1,712,448 | 5/1929 | Eckhardt | 190/103 |
| 1,951,527 | 3/1934 | Oas | 383/4 X |
| 2,079,220 | 5/1937 | Mahoney | 2/94 |
| 2,248,455 | 7/1941 | Freund | 224/153 X |
| 2,304,574 | 12/1942 | Kirschenbaum | 2/94 |
| 2,428,795 | 10/1947 | Frazee | 224/153 |
| 2,507,322 | 5/1950 | Smith | 2/94 X |
| 2,620,479 | 12/1952 | Buck | 2/94 |
| 2,755,480 | 7/1956 | Jones et al. | 2/94 |
| 2,865,433 | 12/1958 | Warner | 383/4 X |
| 2,970,316 | 2/1961 | Silin | 2/94 |
| 4,213,549 | 7/1980 | Hibbard | 224/153 X |
| 4,389,735 | 6/1983 | McLaughlin | 2/94 |
| 4,433,802 | 2/1984 | Woolf | 224/153 |
| 4,555,812 | 12/1985 | Akers | 2/94 |
| 4,563,777 | 1/1986 | Park | 2/856 X |
| 4,662,550 | 5/1987 | O'Donnell | 224/153 X |
| 4,669,127 | 6/1987 | Swanson | 2/102 X |
| 4,689,831 | 9/1987 | Greenberger et al. | 2/94 X |

FOREIGN PATENT DOCUMENTS

| | | | |
|---|---|---|---|
| 637780 | 10/1936 | Austria | 2/94 |
| 974498 | 2/1951 | France | 190/103 |
| 1002897 | 3/1952 | France | 224/209 |
| 1005432 | 4/1952 | France | 224/209 |
| 1474951 | 3/1967 | France | 190/103 |
| 2365933 | 4/1978 | France | 2/94 |
| 2500275 | 8/1982 | France | 2/94 |
| 1208113 | 10/1970 | United Kingdom | 190/103 |

*Primary Examiner*—Werner H. Schroeder
*Assistant Examiner*—Jeanette E. Chapman
*Attorney, Agent, or Firm*—Rogers & Killeen

[57] ABSTRACT

A collapsible multicompartmented pack able to be affixed to the back of a garment. The pack may include two compartments; a first boxlike collapsible compartment and a second flat compartment that may have snaps for compressing the first compartment between the back of the garment and the second compartment. A single cover is provided that may either close the first compartment when it is expanded or cover both the first and second compartments when the first compartment is compressed. Multiple compartments of either type may be provided.

32 Claims, 2 Drawing Sheets

COLLAPSIBLE MULTICOMPARTMENTED PACK FOR THE BACK OF A GARMENT

BACKGROUND OF THE INVENTION

The present invention relates to packs that may be affixed to the backs of garments for comfortably carrying articles of diverse size and shape without the necessity of a separately carried back pack.

The comfortable carriage of articles on the human back and stowage and transport of the means for such carriage have long been recognized as problems for persons in remote locations, such as hunters and campers.

Various proposals have been advanced for dealing with these problems. In some of these proposals, a backpack is affixed to the back of a garment. Such approaches, however, do not take full advantage of the size of the back of the garment. Several small compartments are provided that may be suitable for small items, but unsuited for the comfortable carriage of bulky articles. If larger compartments are provided, the compartments may be cumbersome and interfere with use of the garment when the affixed pack is not being used. Further, the number of flaps, covers, and closure devices for the compartments should be minimized because it is important to the wearer that the garment and pack remain lightweight. See, for example, the semicircular pack with three relatively small horizontal separately covered compartments affixed to the back of a vest in U.S. Pat. No. 4,669,127 issued to Swanson on June 2, 1987.

In another approach to solving these problems, multiple compartments are arranged about the waist of a user. See, for example, U.S. Pat. No. 2,948,898 to Allen dated July 18, 1957 in which separate compartments are affixed to the lower part of a hunting coat. Here again, the multiple compartments are neither large nor closed by a single cover.

Other approaches propose devices in which the means for carrying the pack is collapsed into the pack when the pack is not being carried. Such devices may not be useful in remote locations because the pack's contents must be removed and carried separately. See U.S. Pat. No. 4,483,469 dated Nov. 20, 1984 to Arisland, and U.S. Pat. No. 4,502,155 dated Mar. 5, 1985 to Itoi, for examples.

It is accordingly an object of the pack of the present invention to provide a novel pack that obviates many of the disadvantages and problems of the prior art.

It is another object of the pack of the present invention to provide a pack which is has multiple compartments covering a substantial portion of the back of the garment to which the pack is attached.

It is still another object of the pack of the present invention to provide a multicompartmented pack in which a first inner compartment is collapsible and is held collapsed with fittings attached to a second outer compartment.

It is a further object of the pack of the present invention to provide a collapsible multicompartmented pack which has a single piece of fabric for covering all the of openings of the compartments when the pack is collapsed and for covering the largest compartment when the pack is not collapsed.

It is still a further object of the pack of the present invention to provide a multicompartmented utility vest with a collapsible pack affixed to the back of the vest, the pack having a single cover that may selectively cover all or only one of the compartments.

These and many other objects and advantages will be readily apparent to one skilled in the art to which the invention pertains from a perusal of the claims, appended drawings, and the following detailed description of preferred embodiments.

THE DRAWINGS

DETAILED DESCRIPTION OF PREFERRED EMBODIMENTS

Figure 1:
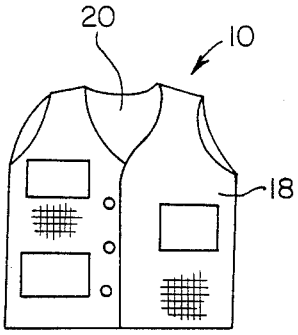
FIG. 1 is a pictorial illustration of the front of a garment for carrying the pack of the present invention.
Figure 2:
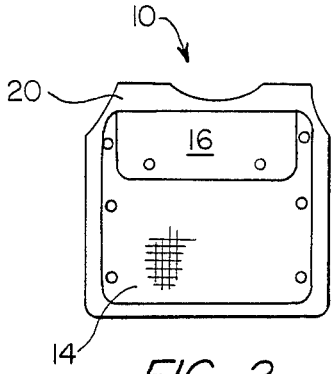
FIG. 2 is a pictorial illustration of the back of the garment of FIG. 1 carrying an embodiment of the pack of the present invention in the compressed position.
Figure 3:
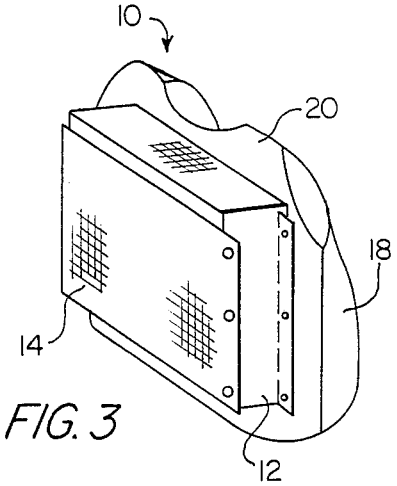
FIG. 3 is a pictorial illustration of a perspective view of the garment and pack of FIG. 2 showing the pack in the expanded position.

With reference to the figures where like elements have been given like numerical designation to facilitate an understanding of the present invention, and particularly with reference to the embodiment of the pack of the present invention illustrated in FIGS. 1, 2, and 3, the pack may be carried on the back of a garment 10 such as a vest (FIG. 1) and may include a first boxlike compartment 12 which is collapsible, a second generally flat compartment 14 which has means for compressing the first compartment, and a cover 16 which may be used to cover the first and second compartments when the first compartment is collapsed (FIG. 2) or to close the first compartment when the compartment is expanded (FIG. 3).

As is generally known, the garment 10 may provide shoulder and front support members so that the pack of the present invention may be carried comfortably when full. In a vest, for example, such members take the form of front panels 18 which are joined in the front and a back panel 20 to which the pack may be affixed.

It is desirable that the pack be as spacious as possible, and, to that end, the compartments 12 and 14 should generally conform to the shape of the back panel 20

(e.g., rectangular) and should cover a substantial portion of the panel 20. As seen in FIGS. 2 and 3, this means that the panel 20 may be completely covered except for those portions where the panel curves to conform to the sides, shoulder and lower back of the user.

Figure 4:
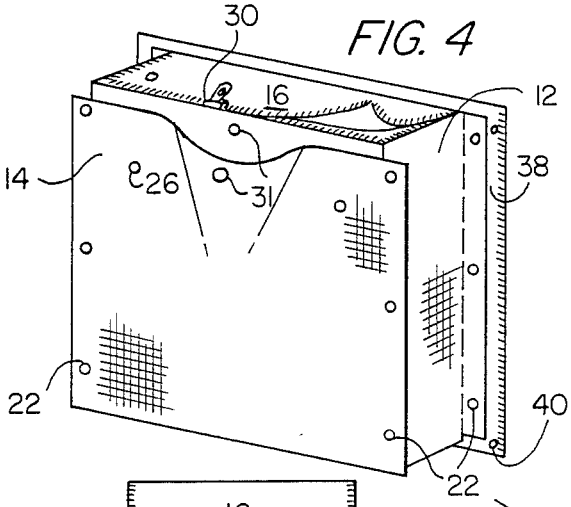
FIG. 4 is a perspective view of another embodiment of the pack of the present invention showing an expanded pack on a mounting panel.
Figure 5:
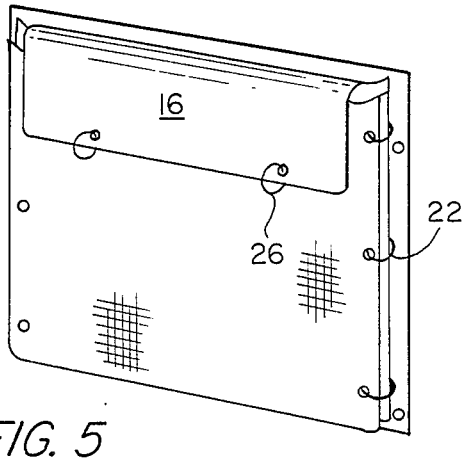
FIG. 5 is a perspective view of the embodiment of FIG. 4 with the pack in the compressed position.

With reference now to FIGS. 4 and 5, the first compartment 12 carries the second compartment 14, which may be affixed to the outside of the first compartment by sewing or may be removably affixed with devices such as snaps. The first compartment 12 is collapsible and may be held compressed by portions of the second compartment 14. To that end, the compartments 12 and 14 may include securing means 22 for holding their corresponding sides together along their length, such as snaps, laces, Velcro adhesive pads, or other means known in the art. When the corresponding sides are held together, the first compartment 12 is held compressed by the second compartment 14 as shown in FIG. 5.

The first compartment may be provided with a cover 16 corresponding to the size of the opening at the top of the expanded first compartment. When the first compartment is compressed, the cover 16 overlies the openings of both compartments 12 and 14 to protect their contents.

The cover 16 may have two closing devices. The first such device 26 secures the cover to the outer portion of the second compartment 14 when the first compartment 12 is compressed and may include snaps, laces, Velcro adhesive pads, or other means known in the art. The second closing device 30 closes the top of the first compartment 12 when the compartment is expanded and may include a zipper, snaps or other suitable means known in the art. A zipper or zipper-like device is preferred because it can hold the entire cover 16 in place overlying the top of the first compartment. A closure device 31, such as a snap, may also be provided to close the second compartment.

The compartments 12 and 14 may be provided with a lining conforming to the inside of the compartment (not shown) that is impervious to fluids. If so provided, the pack can transport damp articles without discomfort to the user.

Figure 6:
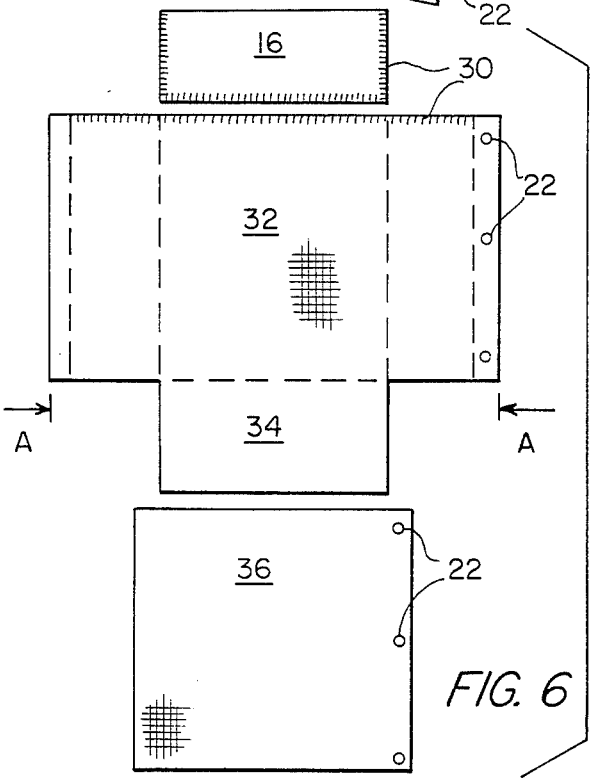
FIG. 6 is a plan view of the fabric used to form an embodiment of the pack of the present invention.
Figure 6A:
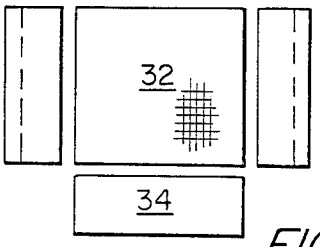
FIG. 6A is a plan view of an alternative embodiment of one of the fabric used to form the pack of the present invention.

With reference now to FIG. 6, the pack of the present invention may be constructed of fabric suitable for the pack's intended use. The first compartment 12 may be formed from a sheet of fabric 32 that has a side-to-side width A greater than the corresponding side-to-side width of the back panel 20. One section at each of the distal sides of the sheet 32 may be used for the securing means 22 for compressing the first compartment. The sheet 32 may be formed from separate sheets as seen in FIG. 6A or folded as indicated by the dashed lines in FIG. 6 to form the first boxlike compartment. The bottom panel 34 of the first compartment and the cover 16 may be generally the same size, matching the width and depth dimensions of the compartment established by the sheet 32.

Figure 6B:
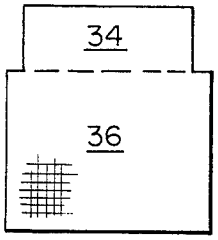
FIG. 6B is a plan view of another alternative embodiment of one of the fabric used to form the pack of the present invention.

The second compartment may be formed from a generally rectangular sheet of fabric 36 having a height equal to or slightly less than the height of sheet 32 and a width slightly greater than that of the bottom panel 34. The extra width provides space for the securing means 22 for compressing the first compartment. The bottom panel 34 may be integral with sheet 36 as shown in FIG. 6B.

Figure 7A:
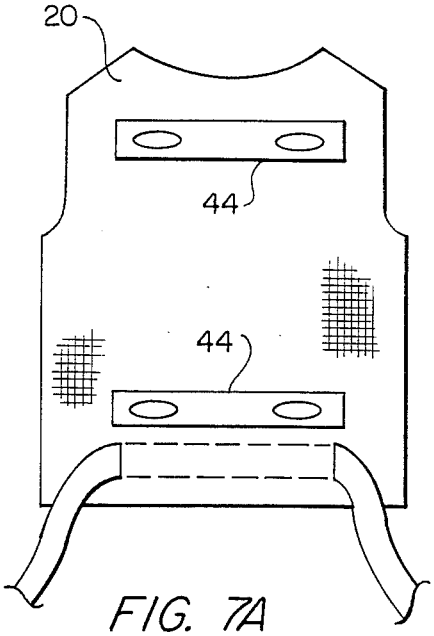
FIG. 7A is a partial view of the back of a garment showing means for attaching the pack of the present invention.
Figure 7B:
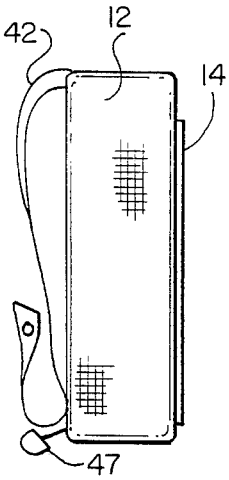
FIG. 7B is a side pictorial view of an embodiment of the present invention showing straps for attachment to the garment shown in FIG. 7A.

In an alternative embodiment, and with reference again to FIG. 4, the pack of the present invention may be carried by a mounting panel 38 for easily removing the pack (e.g., for cleaning or for transferring it to another garment). The cover 16 and sheets 32 and 34 may be affixed to the panel 38 by sewing or other means. The panel 38 may then be attached to the back of a garment with mounting devices 40 such as snaps, zippers, or other devices known in the art. As seen in FIGS. 7A and 7B, the pack may also include straps 42 corresponding to suitable receptors 44 added to the back panel 20 of the garment. The receptors 44, for attaching the pack, may be fabric strips with openings for the straps 42, or rings. The straps may be adjustable for alternative transport of the pack when it is not attached to a garment.

With further reference to FIGS. 7A and 7B the pack of the present invention may also include a waist belt 45 to support a portion of the weight of the pack. The belt 45 pulls the lower, weight bearing portion of the pack into the small of the back of the user and reduces the load on the user's shoulders. The belt 45 may extend through suitable fixtures, such as D-rings, on the back of the pack or on mounting panel 38, through back panel 20, and around the waist of the user. The belt may be removable for storage in the pack when not in use, or permanently affixed to the pack.

Figure 8:
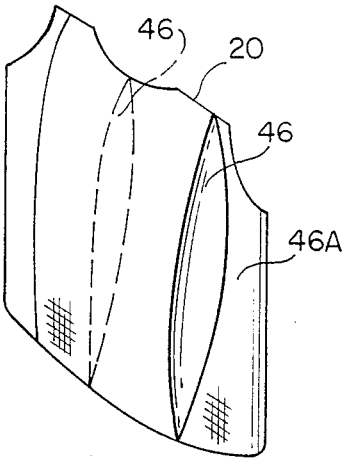
FIG. 8 is a perspective view of the back of a garment showing expansion panels.

As seen in FIG. 8, the back panel 20 may also include one or more expansion panels 46 to allow the garment to fit various size users. Such panels 46 would also make a full pack more comfortable to carry. The back panel 20 may be folded to form the expansion panels 46, or separate pieces of fabric may be used. The expansion panel(s) 46 may be placed at suitable locations so as not to interfere with the pack, such as the sides or middle of the panel 20. The back panel 20 may consist of separate expansion panels 46A located below the shoulder which wrap around the sides of the user's torso to join the front panels 18 of the garment.

Figure 9:
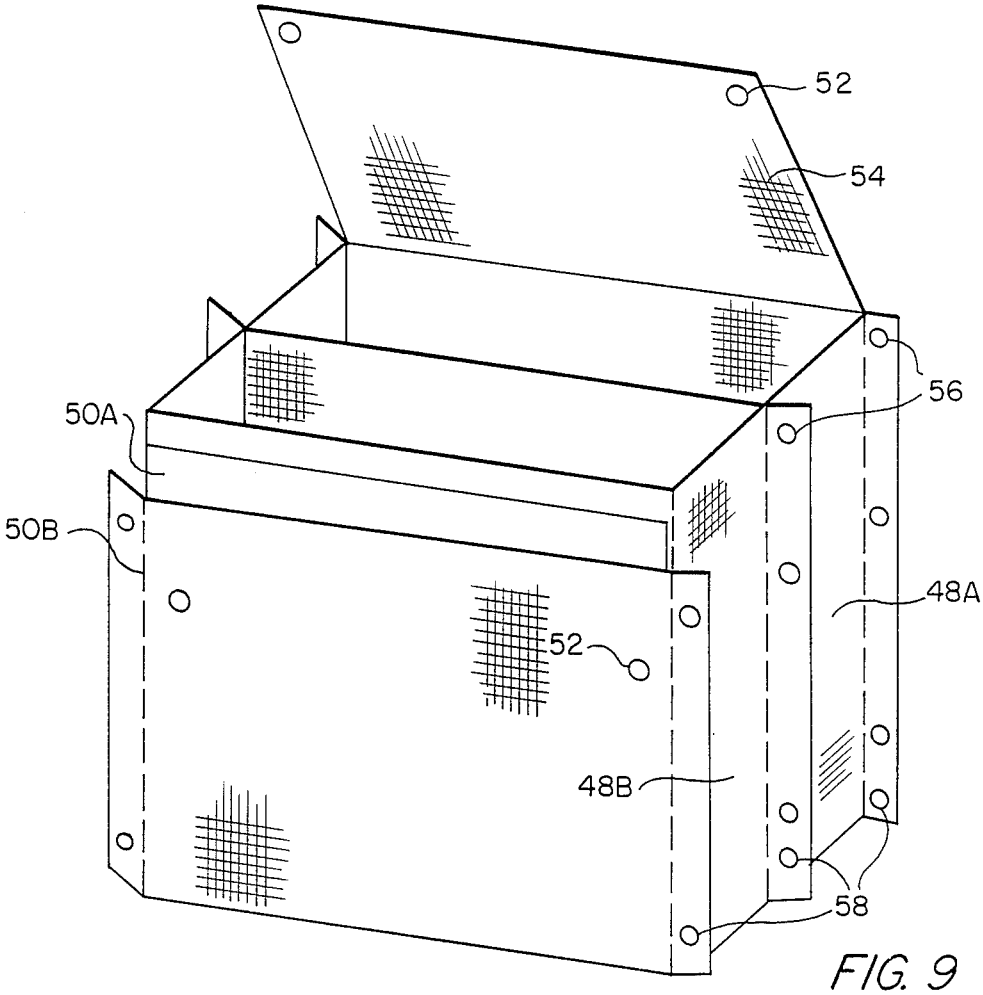
FIG. 9 is a pictorial illustration of a perspective view of an alternative embodiment of the pack of the present invention showing multiple compartments.

In another embodiment seen in FIG. 9, the pack may have multiple collapsible compartments and multiple flat compartments. Each collapsible compartment may be formed from a sheet 48A, 48B arranged as shown for sheet 32 in FIG. 6. The flat compartments 50A, 50B may be nested in any suitable manner, provided the outermost flat compartment has means 52 for securing the cover 54. This arrangement creates an accordion-like array of compartments that may be individually collapsed with securing devices 56 or totally collapsed using devices 58 attached to the outermost flat compartment. The cover 54 may overlie the openings of all collapsible compartments when they are expanded and cover both collapsible and flat compartments when the collapsible compartments are compressed.

While preferred embodiments of the present invention have been described, it is understood that the embodiments described are illustrative only and that the scope of the invention is to be defined solely by the appended claims when accorded a full range of equivalence, many variations and modifications naturally occurring to those skilled in the art from a perusal thereof.

I claim:

1. A utility vest with multiple storage compartments on a back thereof comprising:

(a) two front panels having means to join said two front panels in a front of the vest;

(b) a back panel affixed to the sides of said two front panels to form a vest-like garment;

(c) a first collapsible compartment affixed to and substantially covering said back panel with an opening at its top, said first compartment comprising:

a first generally rectangular panel having a side-to-side width larger than the corresponding side-to-side width of said back panel, the sides of said first panel being affixed to the sides of said back panel to form the sides and back of the first compartment, a second panel affixed to said vest back panel and to said first panel to form the bottom of said first compartment, a third panel affixed to said back panel and having first closing means for selective attachment to said first panel to thereby form a top for said first compartment whereby the opening at the top of said first compartment may be closed; and (d) a second flat compartment carried on an outside of said first compartment having generally the same width and height as said first compartment, said second compartment comprising a fourth generally rectangular panel affixed on both sides and the bottom to the outside of said first panel to form said second compartment with an opening at the top thereof, said first and fourth panels having second closing means for selectively retaining said first compartment in a collapsed position by removably joining said first and fourth panels at the sides thereof, said third panel and said fourth panel having third closing means for selectively retaining said third panel in an overlying position with respect to said first and second compartments.

2. The vest as defined in claim 1 wherein said first closing means comprises a zipper.

3. The vest as defined in claim 1 wherein said second closing means comprises snaps.

4. The vest as defined in claim 1 wherein said third closing means comprises snaps.

5. The vest as defined in claim 1 wherein said second closing means comprises laces.

6. The vest as defined in claim 1 wherein said third closing means comprises laces.

7. The vest as defined in claim 1 wherein the volume of said first compartment is substantially greater than the volume of said second compartment.

8. The vest as defined in claim 1 wherein said first compartment further comprises a moisture-impervious lining.

9. The vest as defined in claim 1 wherein said first compartment is removably affixed to said back panel.

10. The vest as defined in claim 1 wherein said second compartment is removably affixed to said first compartment.

11. The vest as defined in claim 1 further comprising fourth closing means for selectively closing said second opening.

12. The vest as defined in claim 1 wherein said back panel comprises expansion panels for allowing the width of said back panel to expand.

13. The vest as defined in claim 1 further comprising a waist belt carried by said first compartment for supporting said vest on the lower back of a user.

14. A pack with plural compartments constructed of fabric for a back of a garment comprising:

(a) a first collapsible compartment having an opening at its top and adapted to be affixed to a garment on the back thereof, said first compartment comprising:

a first generally rectangular panel of fabric having two opposing sides that are adapted to be affixed to sides of the back of a garment for forming sides and back of said first compartment, said first panel of fabric substantially covering the back of the garment and having a side-to-side width greater than the side-to-side width of the back of the garment, and a second generally rectangular panel of fabric able to be affixed to the back of the garment and to said first panel of fabric for forming the bottom of said first compartment;

(b) a second compartment affixed to an outside of the back of said first compartment, said second compartment comprising a third generally rectangular panel of fabric substantially covering the outside of the back of said first compartment;

(c) first securing means for removably attaching said two opposing sides of said first panel of fabric to corresponding opposing sides of said third panel of fabric, whereby said first compartment may be compressed against the back of a garment and held compressed by said first securing means; and (d) a cover panel for overlying said first and second compartments when said first compartment is compressed and for overlying said first compartment when said first compartment is not compressed, said cover panel comprising:

a fourth generally rectangular panel of fabric affixed to the garment adjacent said opening, second securing means for removably attaching said fourth panel of fabric to said third panel of fabric whereby said first and second compartments are overlain by said fourth panel of fabric when said first compartment is compressed, and third securing means for selective attachment of said fourth panel of fabric to said first panel of fabric when said first compartment is expanded.

15. The pack as defined in claim 14 wherein said second securing means comprises a zipper.

16. The pack as defined in claim 14 further comprising a mounting panel able to be removably attached to the back of a garment for attaching said first compartment, said second panel of fabric, and said cover panel, whereby said pack may be detached from a garment.

17. The pack as defined in claim 16 further comprising a waist belt carried by said first compartment for supporting said pack on the lower back of a user.

18. A pack for the back of a garment having multiple collapsible compartments, said pack comprising:

(a) one or more first pieces of fabric adjoined at their sides for forming an accordian-like array of collapsible first compartments, each of said first compartments having a boxlike shape when expanded with an opening at its top, wherein each of said first pieces of fabric has a side-to-side width greater than the corresponding side-to-side width of the back of the garment, whereby the back of the garment is substantially covered by said first pieces of fabric;

(b) one or more second pieces of fabric joined to the outermost one of said first pieces of fabric for forming substantially flat second compartments, each having an opening at its top;

(c) plural first closing means mounted on said first and second pieces of fabric for selectively compressing and holding compressed said first compartments;

(d) a cover panel for covering the openings of said first and second compartments when said first compartments are collapsed and for covering only the openings of said first compartments when said first compartments are expanded, said cover panel comprising a third piece of fabric conforming to the combined opening of said first compartments, said cover panel and the outermost of said second pieces of fabric having first closure means for holding said panel over the openings of the first and second compartments when said first compartments are collapsed, and said cover panel and said first pieces of fabric having second closure means for covering the openings of said first compartments when said first compartments are expanded.

19. The pack as defined in claim 14 wherein said first securing means comprises snaps.

20. The pack as defined in claim 14 wherein said first securing means comprises laces.

21. The pack as defined in claim 14 wherein the volume of said first compartment is substantially greater than the volume of said second compartment.

22. The pack as defined in claim 14 wherein said first compartment further comprises a moisture-impervious lining.

23. The pack as defined in claim 14 wherein said second compartment is removably affixed to said first compartment.

24. The pack as defined in claim 18 wherein said plural first closing means comprise snaps.

25. The pack as defined in claim 18 wherein said plural first closing means comprise laces.

26. The pack as defined in claim 18 wherein said first closure means comprises snaps.

27. The pack as defined in claim 18 wherein said first closure means comprises laces.

28. The pack as defined in claim 18 wherein said second closure means comprises a zipper.

29. The pack as defined in claim 18 wherein the volumes of each of said first compartments when expanded are substantially equal and are greater than the volumes of each of said second compartments.

30. The pack as defined in claim 18 wherein at least one of said first compartments comprises a moisture-impervious lining.

31. The pack as defined in claim 18 wherein the one of said first compartments closest the back of the garment further comprises means for removably affixing said one first compartment to the back of the garment.

32. The pack as defined in claim 18 further comprising a waist belt carried by the innermost of said first compartments for supporting said pack on the lower back of a user.

* * * * *